US009807506B2

(12) United States Patent
Wang et al.

(10) Patent No.: US 9,807,506 B2
(45) Date of Patent: Oct. 31, 2017

(54) METHOD AND SYSTEM FOR AUDIO BROADCAST USING LIGHTING DEVICES

(71) Applicant: ZHEJIANG SHENGHUI LIGHTING CO., LTD., Jiaxing (CN)

(72) Inventors: Xia Wang, Jiaxing (CN); Chaoqun Sun, Jiaxing (CN); Jinxiang Shen, Jiaxing (CN)

(73) Assignee: ZHEJIANG SHENGHUI LIGHTING CO., LTD, Jiaxing (CN)

( * ) Notice: Subject to any disclaimer, the term of this patent is extended or adjusted under 35 U.S.C. 154(b) by 24 days.

(21) Appl. No.: 14/902,035

(22) PCT Filed: Apr. 21, 2015

(86) PCT No.: PCT/CN2015/077073
§ 371 (c)(1),
(2) Date: Dec. 30, 2015

(87) PCT Pub. No.: WO2016/029704
PCT Pub. Date: Mar. 3, 2016

(65) Prior Publication Data

US 2016/0227318 A1 Aug. 4, 2016

(30) Foreign Application Priority Data

Aug. 26, 2014 (CN) ..... 2014 1 0424355

(51) Int. Cl.
*H04R 3/00* (2006.01)
*H04R 3/12* (2006.01)
(Continued)

(52) U.S. Cl.
CPC ..... *H04R 3/12* (2013.01); *F21V 33/00* (2013.01); *H04R 1/028* (2013.01); *H04R 27/00* (2013.01);
(Continued)

(58) Field of Classification Search
CPC .. H04R 1/028; H04R 27/00; H04R 2227/005; H04R 2420/07; H04R 3/12; F21V 33/00
See application file for complete search history.

(56) References Cited

U.S. PATENT DOCUMENTS 8,282,227 B2 * 10/2012 Massara ..... F21V 23/0471 362/249.02
2005/0197113 A1 9/2005 Lin
2009/0271002 A1 10/2009 Asofsky

FOREIGN PATENT DOCUMENTS

CN 103108454 A 5/2013
CN 103501558 A 1/2014
(Continued)

OTHER PUBLICATIONS

The World Intellectual Property Organization (WIPO) International Search Report for PCT/CN2015/077073 dated Jul. 28, 2015.

*Primary Examiner* — Muhammad N Edun
(74) *Attorney, Agent, or Firm* — Anova Law Group, PLLC

(57) ABSTRACT

The present disclosure provides an audio broadcast system and method using lighting devices. The audio broadcast system includes a primary lighting device and secondary lighting device(s). Each lighting device includes a Bluetooth module and an audio broadcast module. The primary lighting device and the secondary lighting device(s) are connected to form a wireless transmitting linking path through the Bluetooth modules. The Bluetooth module of the primary lighting device is configured to receive a first audio data from an external device, and to send the first audio data to the secondary lighting device(s). The Bluetooth modules of the secondary lighting device(s) are configured to receive the first audio data from the connected primary lighting device or from connected other secondary lighting device(s). The audio broadcast modules of the primary lighting device
(Continued)

and the secondary lighting device(s) are configured to broadcast the first audio data.

16 Claims, 1 Drawing Sheet

(51) Int. Cl.
*H04R 1/02* (2006.01)
*H04R 27/00* (2006.01)
*F21V 33/00* (2006.01)

(52) U.S. Cl.
CPC .... *H04R 2227/005* (2013.01); *H04R 2420/07* (2013.01)

(56) References Cited

FOREIGN PATENT DOCUMENTS

| | | | |
|---|---|---|---|
| CN | 103533716 | A | 1/2014 |
| CN | 203554727 | U | 4/2014 |
| CN | 203645815 | U | 6/2014 |
| CN | 103925583 | A | 7/2014 |
| CN | 104197300 | A | 12/2014 |

* cited by examiner

METHOD AND SYSTEM FOR AUDIO BROADCAST USING LIGHTING DEVICES

CROSS-REFERENCES TO RELATED APPLICATIONS

This PCT application claims the priority of Chinese Patent Application No. 201410424355.3, entitled "Audio Broadcast Method and System using Lighting Devices", filed on Aug. 26, 2014, the entire content of which is incorporated herein by reference.

FIELD OF THE DISCLOSURE

The present disclosure generally relates to the field of lighting technologies and, more particularly, relates to an audio broadcast method and system using one or more lighting devices.

BACKGROUND

LED (Light Emitting Diode) technologies may generally provide advantages in energy conservation, environmental protection, controllable lighting, solid state lighting, and long operational lifetime. LED lamps have been widely used in various applications for public, commercial, and/or indoor lighting.

Currently, a wireless speaker can be combined with an LED lighting device. A smart terminal may employ Bluetooth technology to have the LED lighting device play music from the smart terminal. However, the existing LED lighting device containing the wireless speaker requires a specific wireless transmitter station to control and send audios, so that the music in the smart terminal can be played. However, such specific wireless transmitter station is bulky and expensive, and may not be compatible with different models of smart terminals. In addition, since the specific wireless transmitter station must be used, each LED lighting device may only play music in a smart terminal connected to the LED lighting device itself, which limits application scenarios of the LED lighting device with audio broadcast capabilities.

The disclosed method and system for audio broadcast are directed to solve one or more problems set forth above and other problems in the art.

BRIEF SUMMARY OF THE DISCLOSURE

One aspect of the present disclosure provides an audio broadcast system using lighting devices. The audio broadcast system includes a primary lighting device including a Bluetooth module and an audio broadcast module, and one or more secondary lighting devices each including a Bluetooth module and an audio broadcast module. The primary lighting device and the one or more secondary lighting devices are connected to form a wireless transmitting linking path through the Bluetooth modules of the primary lighting device and the one or more secondary lighting devices. The Bluetooth module of the primary lighting device is configured to receive a first audio data from an external device, and to send the first audio data to the one or more secondary lighting devices. The Bluetooth module of at least one secondary lighting device is configured to receive the first audio data from the primary lighting device or from a different secondary lighting device that are connected to the at least one secondary lighting device. The audio broadcast modules of the primary lighting device and the one or more secondary lighting devices are configured to broadcast the first audio data.

Another aspect of the present disclosure provides an audio broadcast method using lighting devices. A primary lighting device and one or more secondary lighting devices are provided, each lighting device including a Bluetooth module and an audio broadcast module. The primary lighting device and the one or more secondary lighting devices are connected through the Bluetooth modules therein to form a wireless transmitting linking path for the primary lighting device and the one or more secondary lighting devices. The Bluetooth module of the primary lighting device receives a first audio data from an external device and sends the first audio data to the one or more secondary lighting devices through the wireless transmitting linking path. The Bluetooth module of at least one secondary lighting device receives the first audio data from the primary lighting device or from a different secondary lighting device of the one or more secondary lighting devices, connected to the at least one secondary lighting device. The audio broadcast modules of the primary lighting device and the one or more secondary lighting devices broadcast the first audio data.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiment, persons of ordinary skill in the art may derive other embodiments consistent with the present disclosure, all of which are within the scope of the present invention.

The disclosed methods and systems for audio broadcast may solve technical problems related to using bulky and expensive specific wireless transmitter station to play music stored in a smart terminal connected to the LED lighting device, which limits applications of the LED lighting device with audio broadcast capabilities. For example, the disclosed methods and systems may include a primary lighting device and secondary lighting device(s) to form a wireless transmitting linking path via Bluetooth modules in all lighting devices. When receiving one or more audio data, the Bluetooth module of the primary lighting device may transmit the audio data to the secondary lighting device(s). Therefore, any one(s) of the primary lighting device and the secondary lighting device(s) may play the same or different audio data without using conventional bulky and expensive specific wireless transmitter station, such that the disclosed systems and methods may be widely used in various applications as desired.

Figure 1:
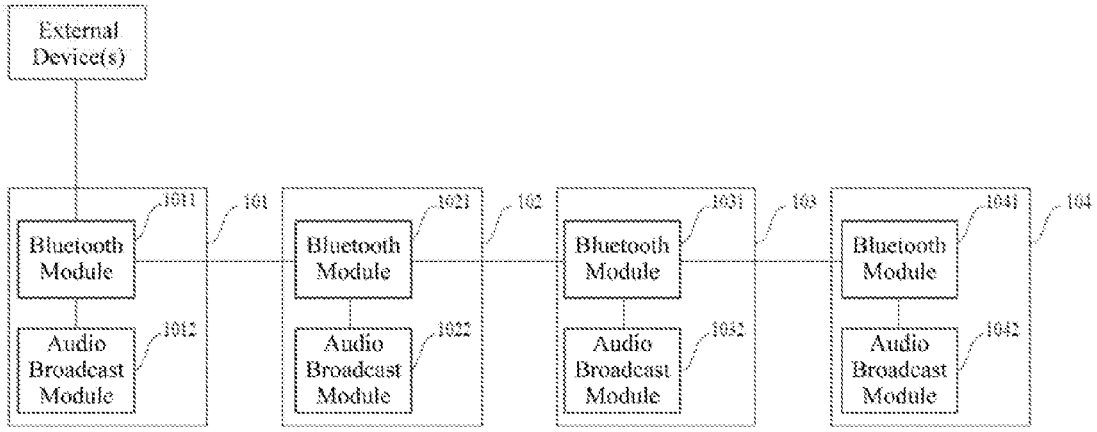
FIG. 1 is a system diagram illustrating an exemplary audio broadcast system using lighting devices consistent with various embodiments of the present disclosure.

FIG. 1 is a system diagram illustrating an exemplary audio broadcast system using lighting devices consistent with various embodiments of the present disclosure. The audio broadcast system may include a primary lighting device 101 and one or more secondary lighting devices. For example, as shown in FIG. 1, the audio broadcast system may include three secondary lighting devices: a first secondary lighting device 102, a second secondary lighting device 103 and a third secondary lighting device 104. Note that any number of the secondary lighting devices (e.g., more or less than three) may be included in the audio broadcast system and other devices may also be included.

The primary lighting device 101 may include a Bluetooth module 1011 and an audio broadcast module 1012. The first secondary lighting device 102 may include a Bluetooth module 1021 and an audio broadcast module 1022. The second secondary lighting device 103 may include a Bluetooth module 1031 and an audio broadcast module 1032. The third secondary lighting device 104 may include a Bluetooth module 1041 and an audio broadcast module 1042.

The primary lighting device 101 may use the Bluetooth module 1011 to connect to the Bluetooth module 1021 of the first secondary lighting device 102. The Bluetooth module 1021 of the first secondary lighting device 102 may then connect to the Bluetooth module 1031 of the second secondary lighting device 103. Further, the Bluetooth module 1031 of the second secondary lighting device 103 may connect to the Bluetooth module 1041 of the third secondary lighting device 104. Therefore, a wireless transmitting linking path can be formed among the primary lighting device and the secondary lighting device(s).

The Bluetooth modules of the primary lighting device 101 and at least one secondary lighting device (for example, the first, second, and/or third secondary lighting devices 102/103/104), may connect to a single external device or connect to multiple external devices simultaneously.

The Bluetooth module 1011 of the primary lighting device 101 may be configured to receive a first audio data from the external device, and to send the first audio data to the first secondary lighting device 102, the second secondary lighting device 103 and/or the third secondary lighting device 104. The external device may be any smart device having a Bluetooth module, such as a computer, a cell phone, a music player, a tablet computer, etc.

The Bluetooth module 1011 of the primary lighting device 101 may relay the first audio data to the first secondary lighting device 102, the second secondary lighting device 103 and/or the third secondary lighting device 104. In one embodiment. The Bluetooth module 1011 of the primary lighting device 101 may send the first audio data to the first secondary lighting device 102. The Bluetooth module 1021 of the first secondary lighting device 102 may be configured to receive the first audio data from the primary lighting device 101 and to send the first audio data to the second secondary lighting device 103. Further, the Bluetooth module 1031 of the second secondary lighting device 103 may be configured to receive the first audio data from the first secondary lighting device 102 and to send the first audio data to the third secondary lighting device 103. The Bluetooth module 1041 of the third secondary lighting device 104 may be configured to receive the first audio data from the second secondary lighting device 103.

The audio broadcast modules 1012, 1022, 1032 and 1042 in the primary lighting device and the one or more secondary lighting devices, respectively, may be configured to broadcast the first audio data.

In the disclosed audio broadcast system using lighting devices, any lighting device may be used as a primary lighting device or a secondary lighting device without limitation. Any lighting device in the system may be functioned as a primary lighting device or a secondary lighting device. For example, one of a plurality of lighting devices may receive audio data from an external device, which may then be considered as the primary lighting device, while other lighting devices of the plurality of lighting devices in the system may be used as the secondary lighting devices.

In certain embodiments, the system may include a plurality of secondary lighting devices. As long as one of these secondary lighting devices can receive an audio signal, the audio signal may be transmitted or propagated through cascading layers of other secondary lighting devices, which extends the coverage range of the wireless network. Such wireless network may provide a self-organized network to transmit and broadcast the audio signals and to avoid using conventional transmitter station to perform signal transmission.

Therefore, in an exemplary embodiment, the disclosed system may include a plurality of lighting devices having audio broadcast capabilities to play same audio data. Such system may be used in various applications. For example, in a household, every room may be installed with one or more lighting devices each having audio broadcast capabilities. A user (e.g., house owner) or may operate a cell phone in one of the rooms to connect to the lighting device in this room via Bluetooth communication. For example, when the user plays Song 1 on the cell phone, the lighting devices in all rooms may play the Song 1 at the same time so that family members or users in other rooms may share the music.

In certain embodiments, the Bluetooth module of any one of the primary lighting device 101, the first secondary lighting device 102, the second secondary lighting device 103 and the third secondary lighting device 104 may be configured to receive a broadcast interruption command from an external device and to send the broadcast interruption command to the audio broadcast module of the same lighting device.

Alternatively, the Bluetooth module may send the broadcast interruption command to the audio broadcast modules of different lighting device(s) from the primary lighting device 101, the first secondary lighting device 102, the second secondary lighting device 103 and the third secondary lighting device 104.

For example, the Bluetooth module 1021 of the first secondary lighting device 102 may receive a broadcast interruption command from an external device. The Bluetooth module 1021 may either send the broadcast interruption command to the audio broadcast module 1022 of the first secondary lighting device 102, or send the broadcast interruption command to all the audio broadcast modules 1012, 1022, 1032 and 1042.

The audio broadcast modules of the primary lighting device and the one or more secondary lighting devices may be further configured to stop playing the first audio data when receiving the broadcast interruption command.

The broadcast interruption command may be from a same external device which sends the first audio data, or from a different external device. That is, a plurality of external devices may simultaneously connect to the Bluetooth module of any one of the primary lighting device and the one or more secondary lighting devices. For example, when the primary lighting device and the one or more secondary lighting devices are playing a first audio data from a first external device, and when the Bluetooth module of any one of these lighting devices receives a broadcast interruption command, the first audio data may be stopped from being played. The broadcast interruption command may be from the first external device that sends the first audio data, or from a second external device that is different from the first external device.

In certain embodiments, as shown in FIG. 1, when the Bluetooth module of one of the lighting devices receives the broadcast interruption command, the Bluetooth module of one of the lighting devices may be pre-configured to send the broadcast interruption command to the audio broadcast module of this one lighting device itself, and/or send the broadcast interruption command to the audio broadcast modules of the primary lighting device 101, the first secondary lighting device 102, the second secondary lighting device 103 and the third secondary lighting device 104.

In an exemplary embodiment, the broadcast interruption command received by the Bluetooth module may only be sent to the audio broadcast module of the same one lighting device itself. For example, in a household where each room is equipped with a lighting device having audio broadcast capabilities. A family member in room A may want to stop the audio broadcast for certain reasons; the family member may operate a cell phone to send a broadcast interruption command to a lighting device A in room A. The lighting device A may receive the broadcast interruption command and stops broadcasting in room A.

In another exemplary embodiment, the broadcast interruption command received by the Bluetooth module may be sent to all the audio broadcast modules of lighting devices including the primary lighting device and the one or more secondary lighting devices. Still in the previous household example, a family member may send a broadcast interruption command to a lighting device in any one of the rooms, all the lighting devices in the household may stop audio broadcasting, so that the family member do not have to go to each room to turn off the music, which satisfies user requirements.

In certain embodiments, in FIG. 1, the Bluetooth module of any one of the primary lighting device 101, the first secondary lighting device 102, the second secondary lighting device 103 and the third secondary lighting device 104 may be configured to receive a second audio data from an external device, and to send the second audio data to the audio broadcast module of the same one lighting device itself. Alternatively, the Bluetooth module may be configured to send the second audio data to the audio broadcast modules of other lighting devices or all lighting devices from the primary lighting device and the one or more secondary lighting devices.

The audio broadcast modules of the primary lighting device and the one or more secondary lighting devices may be further configured to stop playing the first audio data and start playing the second audio data when receiving the second audio data.

The second audio data and the first audio data may be from a same external device, or from different external devices. For example, a plurality of external devices may simultaneously connect to the Bluetooth module of any one of the primary lighting device and the one or more secondary lighting devices. When the primary lighting device and the secondary lighting devices are playing a first audio data from a first external device, and when the Bluetooth module of any one of these lighting devices receives the second audio data, the first audio data is stopped, and the second audio data is played instead. The second audio data may be from the first external device, or from a second external device that is different from the first external device.

In certain embodiments, the Bluetooth module of any one of the primary lighting device and the secondary lighting devices may be configured to receive a second audio data from an external device, and to send the second audio data to the audio broadcast module of the one lighting device itself. Alternatively, the Bluetooth module may be configured to send the second audio data to the audio broadcast modules of all other lighting devices or all lighting devices from the primary lighting device and the one or more secondary lighting devices.

In an exemplary embodiment, the second audio data received by the Bluetooth module of one lighting device may only be sent to the audio broadcast module of the same one lighting device itself. For example, in a household, each room may be equipped with a lighting device having audio broadcast capabilities. When a family member in one of the rooms (room B) does not like Song 1 currently being played, the family member may operate a cell phone to play Song 2 on the cell phone. A lighting device B in room B may play Song 2 while other rooms may still play Song 1, fulfilling the customization needs of the family members in different rooms.

In another exemplary embodiment, the second audio data received by the Bluetooth module may be sent to all the audio broadcast modules of the primary lighting device and the secondary lighting devices. In the previous household example, when switching songs, a family member may connect a cell phone to one lighting device in one of the rooms and play Song 2 on the cell phone, all the lighting devices in the household may stop playing Song 1 and start playing Song 2, so that the family member do not have to go to each room to switch music, which facilitates user operation.

In certain embodiments, the primary lighting and the one or more secondary lighting devices may be LED lights.

In various embodiments, the Bluetooth module of the primary lighting device and the one or more secondary lighting devices may be configured to receive control signals from an external device. The control signals may include audio control signals and light control signals. For example, the audio control signals may include turning the audio broadcast on/off, adjusting audio volume, adjusting sound equalizer according to user preference, etc. The light control signals may include switching the light on/off, adjusting brightness, color and color temperature of the light according to user preference or according to different music styles, etc. Further, the external device may install an Application that provides a user interface to configure the light control signals and the audio control signals separately or in combinations.

Figure 2:
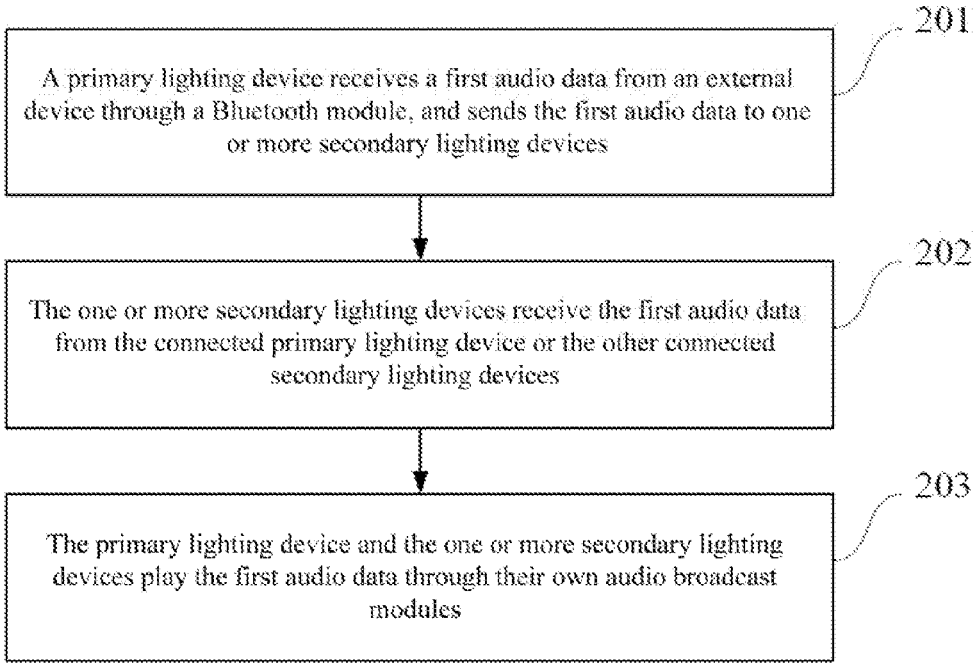
FIG. 2 is a flowchart illustrating an exemplary audio broadcast method for using lighting devices consistent with various embodiments the present disclosure.

FIG. 2 is a flowchart illustrating an exemplary audio broadcast method using lighting devices consistent with various disclosed embodiments of the present disclosure.

As shown in FIG. 2, in Step 201, a primary lighting device may receive a first audio data from an external device through a Bluetooth module, and send the first audio data to one or more secondary lighting devices. The primary lighting device and the one or more secondary lighting devices may form a wireless transmitting linking path through the Bluetooth modules.

The external device may be any smart device having a Bluetooth module, such as a computer, a cell phone, a music player, a tablet computer, etc. The primary lighting device may relay the first audio data to the one or more secondary lighting devices.

In Step 202, at least one secondary lighting device may receive the first audio data from connected lighting device(s), including the primary lighting device and/or the other secondary lighting devices.

In an exemplary embodiment having three secondary lighting devices, the primary lighting device may send the first audio data to a first secondary lighting device that is connected to the primary lighting device. The first secondary lighting device may receive the first audio data and send the first audio data to a second secondary lighting device. Further, the second secondary lighting device may receive the first audio data and send the first audio data to a third secondary lighting device. The third secondary lighting device may be configured to receive the first audio data.

In Step 203, the primary lighting device and the one or more secondary lighting devices may be configured to play the first audio data through their own audio broadcast modules.

Therefore, in an exemplary embodiment, the disclosed method may employ a plurality of lighting devices having audio broadcast capabilities to play the same audio data, and to be used in various applications. For example, in a household, every room is provided with a lighting device having audio broadcast capabilities. The house owner or a user may operate a cell phone in one of the rooms to connect to one lighting device in this room via Bluetooth communication. The owner may play Song 1 on the cell phone, and then the lighting devices in all rooms may play Song 1 at the same time so that family members in other rooms may share the song.

Optionally, the disclosed audio broadcast method may further include additional steps. In one additional step, the Bluetooth module of any one of the primary lighting device and the one or more secondary lighting devices may receive a broadcast interruption command from an external device, and send the broadcast interruption command to the audio broadcast module of the same one lighting device. Alternatively, the Bluetooth module may send the broadcast interruption command to the audio broadcast modules of some or all lighting devices of the primary lighting device and the one or more secondary lighting devices.

In certain embodiments, when the Bluetooth module of any one of the lighting devices receives the broadcast interruption command, the Bluetooth module of one of the lighting devices may be pre-configured to send the broadcast interruption command to the audio broadcast module of this one lighting device, and/or to send the broadcast interruption command to the audio broadcast modules of the primary lighting device and the one or more secondary lighting devices.

In one additional step, the audio broadcast module of the lighting device that receives the broadcast interruption command may stop playing the first audio data.

The broadcast interruption command may be from the same external device that sends the first audio data, or from a different external device. For example, a plurality of external devices may simultaneously connect to the Bluetooth module of any one of the primary lighting device and the secondary lighting devices. When the primary lighting device and the secondary lighting devices are playing a first audio data from a first external device, and when the Bluetooth module of any lighting devices receives the broadcast interruption command, the first audio data are stopped from playing. The broadcast interruption command may be from the first external device, or from a second external device that is different from the first external device.

In an exemplary embodiment, the broadcast interruption command received by the Bluetooth module may only be sent to the audio broadcast module of the same one lighting device itself. For example, in a household, each room may be equipped with a lighting device having audio broadcast capabilities. When a family member in room A wants to stop the audio broadcast, the family member may operate a cell phone to send a broadcast interruption command to a lighting device A in room A. The lighting device A may receive the broadcast interruption command and stops broadcasting in room A.

In another exemplary embodiment, the broadcast interruption command received by the Bluetooth module may be sent to all the audio broadcast modules of lighting devices including the primary lighting device and the secondary lighting devices. As in the previous household example, a family member may send a broadcast interruption command to a lighting device in any one of the rooms, all the lighting devices in the household may stop audio broadcasting, so that the family member do not have to go to each room to turn off the music, which satisfies user requirements.

Optionally, the disclosed audio broadcast method may further include more additional steps.

In an exemplary additional step, the Bluetooth module of any one of the primary lighting device and the secondary lighting devices may be configured to receive a second audio data from an external device, and to send the second audio data to the audio broadcast module of the same one lighting device itself. Alternatively, the Bluetooth module may be configured to send the second audio data to the audio broadcast modules of other lighting devices or all lighting devices from the primary lighting device and the one or more secondary lighting devices.

In certain embodiments, when the Bluetooth module of one of the lighting devices receives the second audio data, the Bluetooth module of one of the lighting devices may be pre-configured to send the second audio data to the audio broadcast module of this one lighting device itself, and/or send the second audio data to the audio broadcast modules of the primary lighting device and the one or more secondary lighting devices.

In another additional step, when an audio broadcast module of a lighting device receives the second audio data, the audio broadcast module may stop playing the first audio data and start playing the second audio data.

The second audio data and the first audio data may be from a same external device, or may be from different external devices. For example, a plurality of external devices may simultaneously connect to the Bluetooth module of any one of the primary lighting device and the secondary lighting devices. For example, when the primary lighting device and the secondary lighting devices are playing a first audio data from a first external device, and when the Bluetooth module of any lighting devices receives the second audio data, the first audio data is stopped and the second audio data is played. The second audio data may be from the first external device, or from a second external device that is different from the first external device.

In an exemplary embodiment, the second audio data received by the Bluetooth module of one lighting device may only be sent to the audio broadcast module of the same one lighting device. For example, in a household where each room is equipped with a lighting device having audio broadcast capabilities. A family member in one of the rooms (room B) does not like Song 1 currently being played, the family member may operate a cell phone to play Song 2 on the cell phone. A lighting device B in room B may play Song 2 while other rooms may still play Song 1, fulfilling the customization needs of the family members in different rooms.

In another exemplary embodiment, the second audio data received by the Bluetooth module may be sent to all the audio broadcast modules of the primary lighting device and the secondary lighting devices. In the previous household example, when switching songs, a family member may connect a cell phone to one lighting device in one of the rooms and play Song 2 on the cell phone, all the lighting devices in the household may stop playing Song 1 and start playing Song 2 instead, so that the family member do not have to go to each room to switch music. This facilitates easy user operations.

In another exemplary embodiment, the control functions of the lighting devices may be implemented in combination with the audio broadcasting functions. In the previous household example, when switching songs, a family member may connect a cell phone to one lighting device in one of the rooms and play Song 2 on the cell phone. At the same time, the lighting device in that room may show a lighting signal (e.g., a flash or a light color change for a short period of time) to indicate that the cell phone has established a connection with the lighting device. Through the cell phone, the user may control all the lighting devices in the household and stop playing Song 1 and start playing Song 2 instead, so that the family member do not have to go to each room to switch music, which facilitates user operation. Further, the lighting device in that room may again display a lighting signal (e.g., a flash or a light color change for a short period of time) to indicate the change of the songs.

In another example, a family member in one of the rooms (room B) may not like Song 1 that is currently being played; the family member may operate a cell phone to play Song 2 on the cell phone. A lighting device B in room B may play Song 2 while other rooms may still play Song 1, fulfilling the customization needs of the family members in different rooms. Further, the lighting device B may display a lighting signal (e.g., a flash or a light color change for a short period of time) to indicate the change of the songs.

In addition, when user changes music played in one or more rooms, the user may define the lighting signals/adjustments associated with the music change. For example, a user may associate the new piece of music to a warmer or cooler color of light generated by one or more of the lighting devices. In one example, a user may change to a new song, and adjust a first lighting device to a warmer color of light (e.g., the lighting device in the kitchen) and a second lighting device to a cooler color of light (e.g., the lighting device in a study) while the system switches to a new song.

In another embodiment, the lighting devices may include sensors, such as motion sensors, temperature sensors, lighting sensors, etc. The lighting and audio broadcasting system may incorporate the readings of the sensors into the audio and lighting control functions. For example, a primary lighting device consistent with the present disclosure may be the lighting device located in the foyer of a house. The primary lighting device may include a motion sensor. When the primary and secondary lighting devices are playing music in the house, the sensor in the primary device may monitor the motion at the front door. If the door opens, the sensor may detect that motion. The primary lighting device may generate an interrupt signal, which may pause the music for a pre-set period of time or a user-defined period of time. The primary lighting device may also generate an interrupt signal and switch to a piece of music (e.g., a third audio data) to welcome the person at the door.

Other sensors, such as temperature sensors, air quality sensors, light sensors, etc. can also be incorporated into the lighting and audio broadcasting system. The sensors can be integrated into the primary and/or second lighting devices. The data read from the sensors can be used to control the lighting and audio broadcasting system. In another example, the primary lighting device may be the lighting device located in the kitchen. The primary lighting device may include an air quality sensor. If the air quality changes (e.g., having smoke in the kitchen), the primary lighting device may incorporate that information and adjust the lighting (e.g., flash) together or separately with the audio signals (e.g., adjusting the volume of music or pause the music).

Various embodiments of the present disclosure may be implemented by software products or combinations of software products and hardware. For example, various modules/devices in the present disclosure may employ application specific integrated circuit (ASIC), or other similar hardware to achieve desired functions. In one embodiment, a software program may be executed by a processor to achieve the previously described steps and functions. Further, the software program and related data structure may be stored in a computer-readable recording medium, such as RAM memory, magnetic or optical drive, a floppy disk, etc. In addition, some disclosed steps and functions may be implemented by hardware, such as electrical circuits configured to cooperate with the processor and execute various steps and functions.

Other embodiments of the disclosure will be apparent to those skilled in the art from consideration of the specification and practice of the invention disclosed herein. It is intended that the specification and examples be considered as exemplary only, with a true scope and spirit of the invention being indicated by the claims.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

The disclosed methods and systems for audio broadcast may solve technical problems related to using conventional bulky and expensive specific wireless transmitter station to play music stored in a smart terminal connected to the LED lighting device, which limits applications of the LED lighting device with audio broadcast capabilities. The disclosed methods and systems for audio broadcast may broad application scenarios of the LED lighting device with audio broadcast capabilities.

As disclosed, a primary lighting device and one or more secondary lighting devices may form a wireless transmitting network through their Bluetooth modules. When receiving a first audio data, the Bluetooth module of the primary lighting device may transmit the first audio data to the one or more secondary lighting devices. Therefore, the primary lighting device and the one or more secondary lighting devices may play the same audio data. In other embodiments, the primary lighting device and the one or more secondary lighting devices may be controlled to, individually or in groups, play the same or different audio data. The disclosed system including these lighting devices may be used in various applications.

What is claimed is:

1. An audio broadcast system, comprising:

a primary lighting device including a Bluetooth module and an audio broadcast module; and one or more secondary lighting devices each including a Bluetooth module and an audio broadcast module, wherein:

the primary lighting device and the one or more secondary lighting devices are connected to form a wireless transmitting linking path through the Bluetooth modules of the primary lighting device and the one or more secondary lighting devices;

the Bluetooth module of the primary lighting device is configured to receive a first audio data from an external device, and to send the first audio data to the one or more secondary lighting devices;

the Bluetooth module of at least one secondary lighting device is configured to receive the first audio data from the primary lighting device or from a different secondary lighting device that are connected to the at least one secondary lighting device; and the audio broadcast modules of the primary lighting device and the one or more secondary lighting devices are configured to broadcast the first audio data;

wherein:

the Bluetooth module of any one lighting device from the primary lighting device and the one or more secondary lighting devices is further configured: to receive a second audio data from an external device; and to send the second audio data to the audio broadcast module in at least one of the any one lighting device, the primary lighting device, and the one or more secondary lighting devices; and the audio broadcast modules of the primary lighting device and the one or more secondary lighting device are configured to stop playing the first audio data and start playing the second audio data when receiving the second audio data.

2. The system according to claim 1, wherein the Bluetooth modules of the primary lighting device and the one or more secondary lighting devices are configured to connect to a single external device, or connect to a plurality of external devices simultaneously.

3. The system according to claim 1, wherein:

the Bluetooth module of any one lighting device from the primary lighting device and the one or more secondary lighting devices is further configured: to receive a broadcast interruption command from an external device, and to send the broadcast interruption command to the audio broadcast module of at least one lighting device of the any one lighting device, the primary lighting device, and the one or more secondary lighting devices; and the audio broadcast modules of the primary lighting device and the one or more secondary lighting device are configured to stop playing the first audio data when receiving the broadcast interruption command.

4. The system according to claim 1, wherein each of the primary lighting device and the one or more secondary lighting devices includes an LED lighting device.

5. An audio broadcast method using lighting devices, comprises:

providing a primary lighting device and one or more secondary lighting devices, each lighting device including a Bluetooth module and an audio broadcast module, wherein the primary lighting device and the one or more secondary lighting devices are connected through the Bluetooth modules therein to form a wireless transmitting linking path for the primary lighting device and the one or more secondary lighting devices;

receiving, by the Bluetooth module of the primary lighting device, a first audio data from an external device;

sending, by the Bluetooth module of the primary lighting device, the first audio data to the one or more secondary lighting devices through the wireless transmitting linking path;

receiving, by the Bluetooth module of at least one secondary lighting device, the first audio data from the primary lighting device or from a different secondary lighting device of the one or more secondary lighting devices, connected to the at least one secondary lighting device;

broadcasting, by the audio broadcast modules of the primary lighting device and the one or more secondary lighting devices, the first audio data;

receiving, by the Bluetooth module of any one lighting device of the primary lighting device and the one or more secondary lighting device, a second audio data from an external device;

sending, by the Bluetooth module of the any one lighting device, the second audio data to the audio broadcast module of the same lighting device; and stopping playing the first audio data and start playing the second audio data by the audio broadcast module of the same lighting device.

6. The method according to claim 5, further comprising:

receiving, by the Bluetooth module of any one lighting device of the primary lighting device and the one or more secondary lighting device, a broadcast interruption command from an external device;

sending, by the Bluetooth module of the any one lighting device, the broadcast interruption command to the audio broadcast module of the same lighting device; and stopping playing the first audio data by the audio broadcast module that receives the broadcast interruption command.

7. The method according to claim 5, further comprising:

receiving, by the Bluetooth module of any one lighting device of the primary lighting device and the one or more secondary lighting devices, a broadcast interruption command from an external device;

sending, by the Bluetooth module of the any one lighting device, the broadcast interruption command to the audio broadcast module of all of the primary lighting device and the one or more secondary lighting devices; and stopping playing the first audio data, by the audio broadcast module that receives the broadcast interruption command.

8. The method according to claim 5, wherein the step of receiving the first audio data from the external device comprises:

receiving, by the Bluetooth module of the primary lighting device, the first audio data from an external audio data source; and relaying the first audio data to send to the one or more secondary lighting devices.

9. The method according to claim 5, wherein the Bluetooth modules of the primary lighting device and the one or more secondary lighting devices are configured to connect to a single external device, or to simultaneously connect to a plurality of external devices.

10. The method according to claim 5, wherein each of the primary lighting device and the one or more secondary lighting devices includes an LED lighting device.

11. An audio broadcast method using lighting devices, comprises:

providing a primary lighting device and one or more secondary lighting devices, each lighting device including a Bluetooth module and an audio broadcast module, wherein the primary lighting device and the one or more secondary lighting devices are connected through the Bluetooth modules therein to form a wireless transmitting linking path for the primary lighting device and the one or more secondary lighting devices;

receiving, by the Bluetooth module of the primary lighting device, a first audio data from an external device;

sending, by the Bluetooth module of the primary lighting device, the first audio data to the one or more secondary lighting devices through the wireless transmitting linking path;

receiving, by the Bluetooth module of at least one secondary lighting device, the first audio data from the primary lighting device or from a different secondary lighting device of the one or more secondary lighting devices, connected to the at least one secondary lighting device;

broadcasting, by the audio broadcast modules of the primary lighting device and the one or more secondary lighting devices, the first audio data;

receiving, by the Bluetooth module of any one lighting device of the primary lighting device and the one or more secondary lighting devices, a second audio data from an external device;

sending, by the Bluetooth module of the any one lighting device, the second audio data to the audio broadcast module of all of the primary lighting device and the one or more secondary lighting devices; and stopping playing the first audio data and starting playing the second audio data by the audio broadcast module that receives the second audio data.

12. The method according to claim 11, further comprising:

receiving, by the Bluetooth module of any one lighting device of the primary lighting device and the one or more secondary lighting device, a broadcast interruption command from an external device;

sending, by the Bluetooth module of the any one lighting device, the broadcast interruption command to the audio broadcast module of the same lighting device; and stopping playing the first audio data by the audio broadcast module that receives the broadcast interruption command.

13. The method according to claim 11, further comprising:

receiving, by the Bluetooth module of any one lighting device of the primary lighting device and the one or more secondary lighting devices, a broadcast interruption command from an external device;

sending, by the Bluetooth module of the any one lighting device, the broadcast interruption command to the audio broadcast module of all of the primary lighting device and the one or more secondary lighting devices; and stopping playing the first audio data, by the audio broadcast module that receives the broadcast interruption command.

14. The method according to claim 11, wherein the step of receiving the first audio data from the external device comprises:

receiving, by the Bluetooth module of the primary lighting device, the first audio data from an external audio data source and relaying the first audio data to send to the one or more secondary lighting devices.

15. The method according to claim 11, wherein the Bluetooth modules of the primary lighting device and the one or more secondary lighting devices are configured to connect to a single external device, or to simultaneously connect to a plurality of external devices.

16. The method according to claim 11, wherein each of the primary lighting device and the one or more secondary lighting devices includes an LED lighting device.

* * * * *